US009697709B2

(12) United States Patent
King et al.

(10) Patent No.: US 9,697,709 B2
(45) Date of Patent: Jul. 4, 2017

(54) MERCHANDISE ACTIVITY SENSOR SYSTEM AND METHODS OF USING SAME

(71) Applicant: Indyme Solutions, LLC, San Diego, CA (US)

(72) Inventors: Greg King, San Diego, CA (US); Derek Morikawa, San Diego, CA (US); Barry Baldwin, San Diego, CA (US); Bill Kepner, San Diego, CA (US); Steve Deal, San Diego, CA (US)

(73) Assignee: Indyme Solutions, Inc., San Diego, CA (US)

( * ) Notice: Subject to any disclaimer, the term of this patent is extended or adjusted under 35 U.S.C. 154(b) by 0 days.

(21) Appl. No.: 14/629,233

(22) Filed: Feb. 23, 2015

(65) Prior Publication Data

US 2016/0086460 A1 Mar. 24, 2016

Related U.S. Application Data

(60) Provisional application No. 62/052,026, filed on Sep. 18, 2014.

(51) Int. Cl.
*G08B 13/14* (2006.01)
*G08B 13/196* (2006.01)

(52) U.S. Cl.
CPC ... *G08B 13/1436* (2013.01); *G08B 13/19695* (2013.01)

(58) Field of Classification Search
CPC ..... G08C 17/02; A61B 5/0026; A61B 5/0452; A61B 5/747; A61N 1/37211; G08B 13/1436; G08B 13/1445; G08B 21/0247; G06Q 10/087; G06K 7/10326
USPC ..... 340/542, 568.2, 568.8, 10.1, 539.13, 340/10.34, 436, 576, 539.23, 531, 539.1, 340/522; 700/278, 300, 302
See application file for complete search history.

(56) References Cited

U.S. PATENT DOCUMENTS

| | | | | |
|---|---|---|---|---|
| 4,741,020 | A | 4/1988 | Deal et al. | |
| 5,465,079 | A * | 11/1995 | Bouchard | G01S 13/325 180/272 |
| 8,695,878 | B2 | 4/2014 | Burnside | |
| 2010/0039247 | A1* | 2/2010 | Ziegler | G06Q 10/06 340/436 |
| 2011/0234397 | A1* | 9/2011 | Fetzer | G08B 21/0261 340/539.13 |
| 2012/0293330 | A1* | 11/2012 | Grant | G08B 13/1427 340/568.8 |
| 2013/0257616 | A1* | 10/2013 | Taylor | G08B 21/0225 340/568.2 |
| 2013/0342316 | A1* | 12/2013 | Ghaffari | H04Q 9/00 340/10.1 |

(Continued)

FOREIGN PATENT DOCUMENTS

| | | |
|---|---|---|
| WO | 2014031651 | 2/2014 |
| WO | 2014047272 | 3/2014 |

*Primary Examiner* — Hoi Lau
(74) *Attorney, Agent, or Firm* — Lewis Kohn & Walker LLP; David M. Kohn; Kari Moyer-Henry

(57) ABSTRACT

Apparatus and systems using merchandise activity sensors for increasing the awareness of interactivity with merchandise on retail store displays (shelves, peg hooks, merchandise pushers, and other Point of Purchase displays) in order to facilitate more effective customer service, reduce theft and to provide additional analysis data related to merchandise/shopper interaction.

18 Claims, 8 Drawing Sheets

MAS Basic Functional Overview

(56) References Cited

U.S. PATENT DOCUMENTS

| | | | | |
|---|---|---|---|---|
| 2015/0077252 | A1* | 3/2015 | King | G08B 13/06 340/542 |
| 2015/0091729 | A1* | 4/2015 | Phillips | G08B 13/1427 340/568.2 |
| 2015/0123771 | A1* | 5/2015 | Otto | G06K 7/0008 340/10.34 |

* cited by examiner

Figure 1: MAS Basic Functional Overview
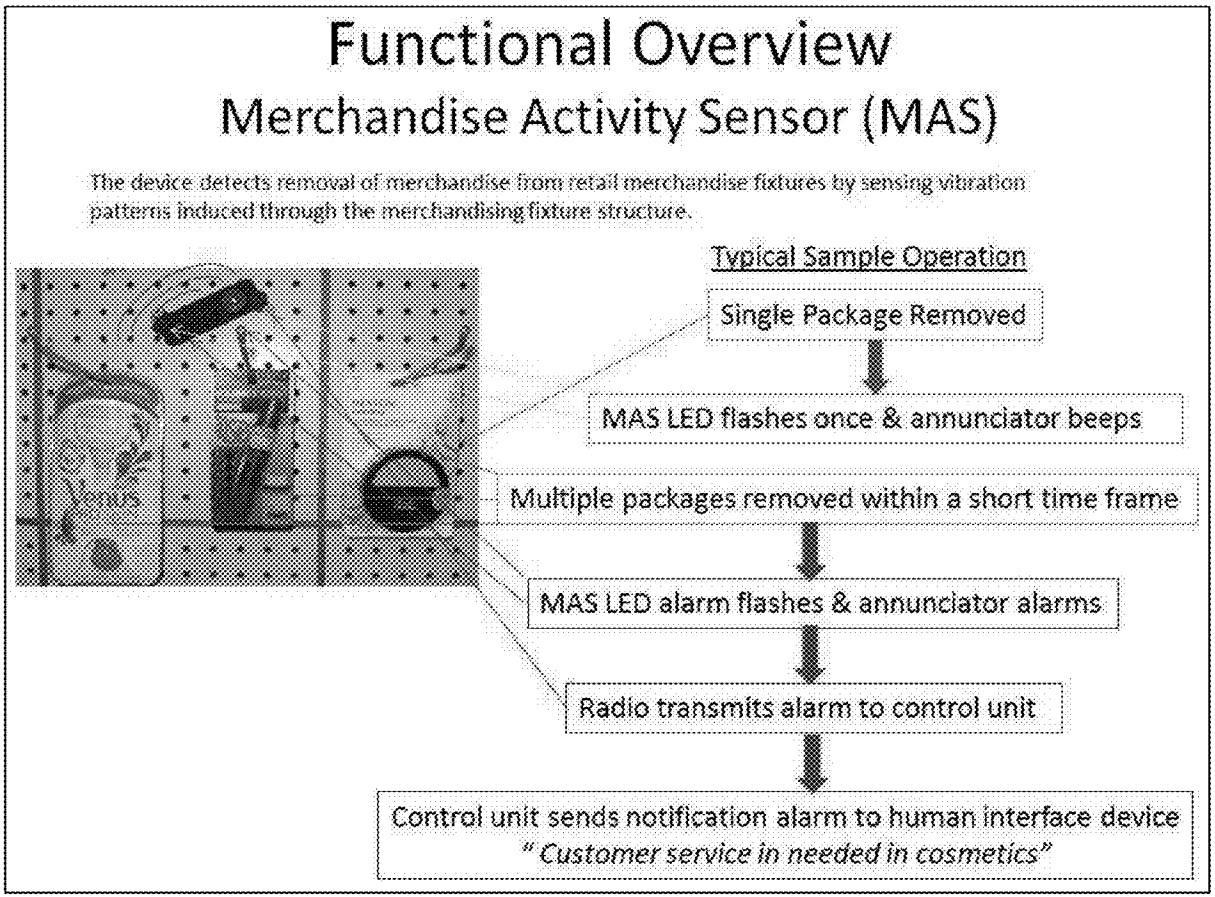

Figure 2: MAS Functional Block Diagram
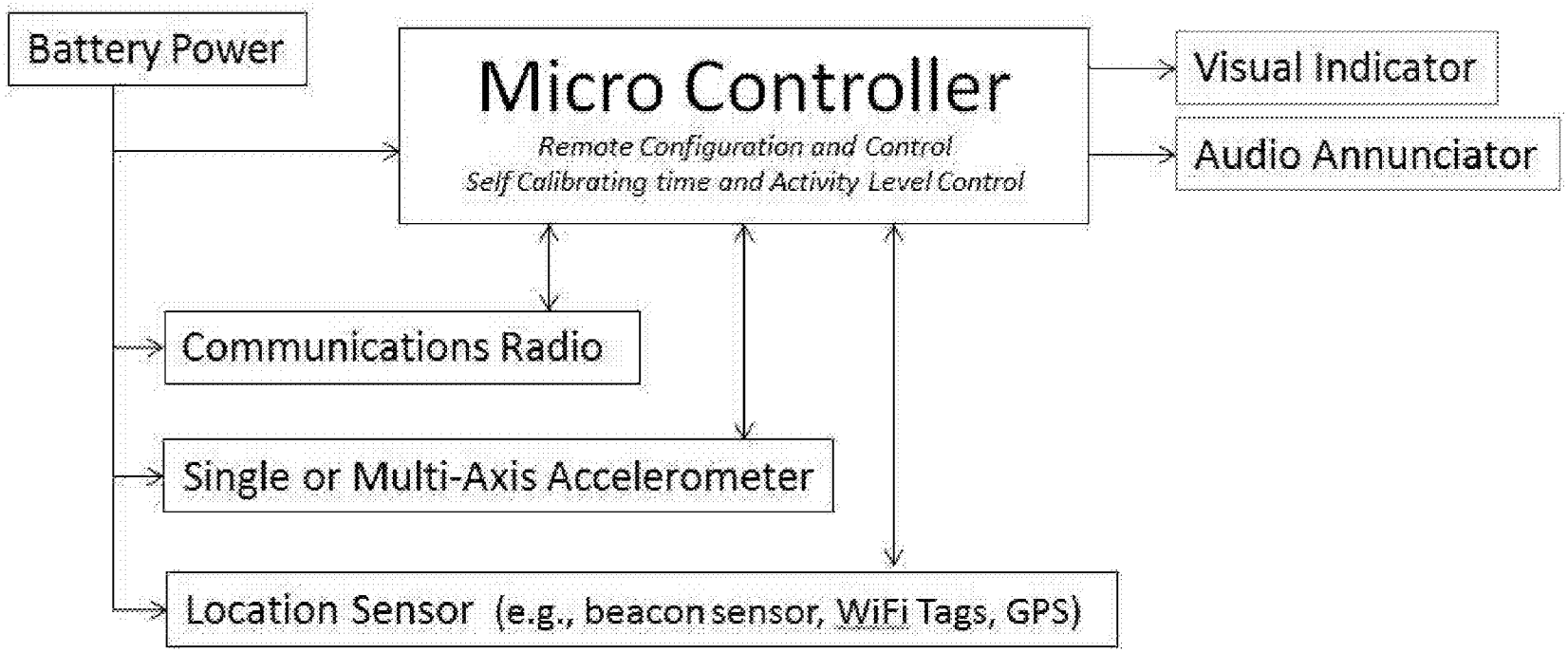

Figure 3: MAS System Level Integrations
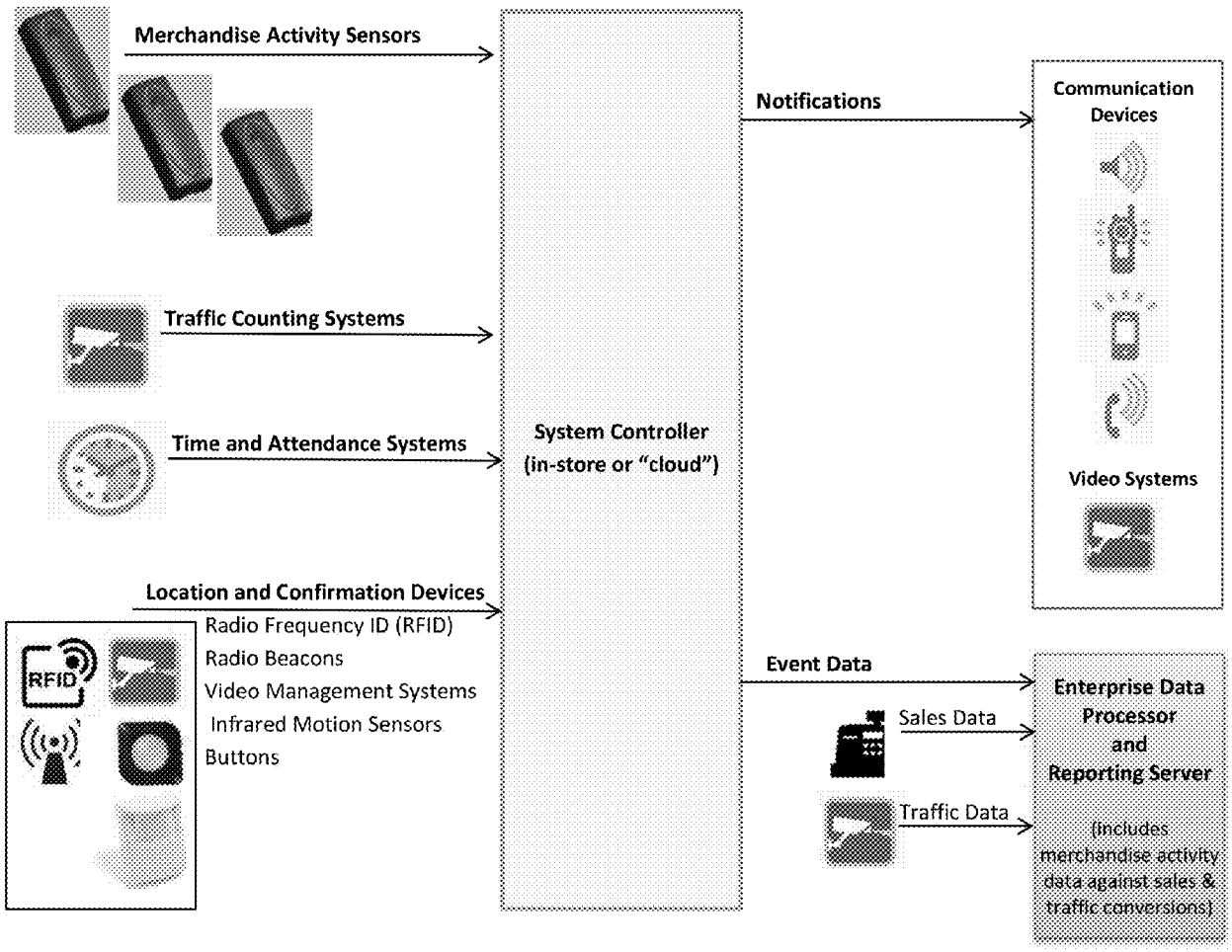

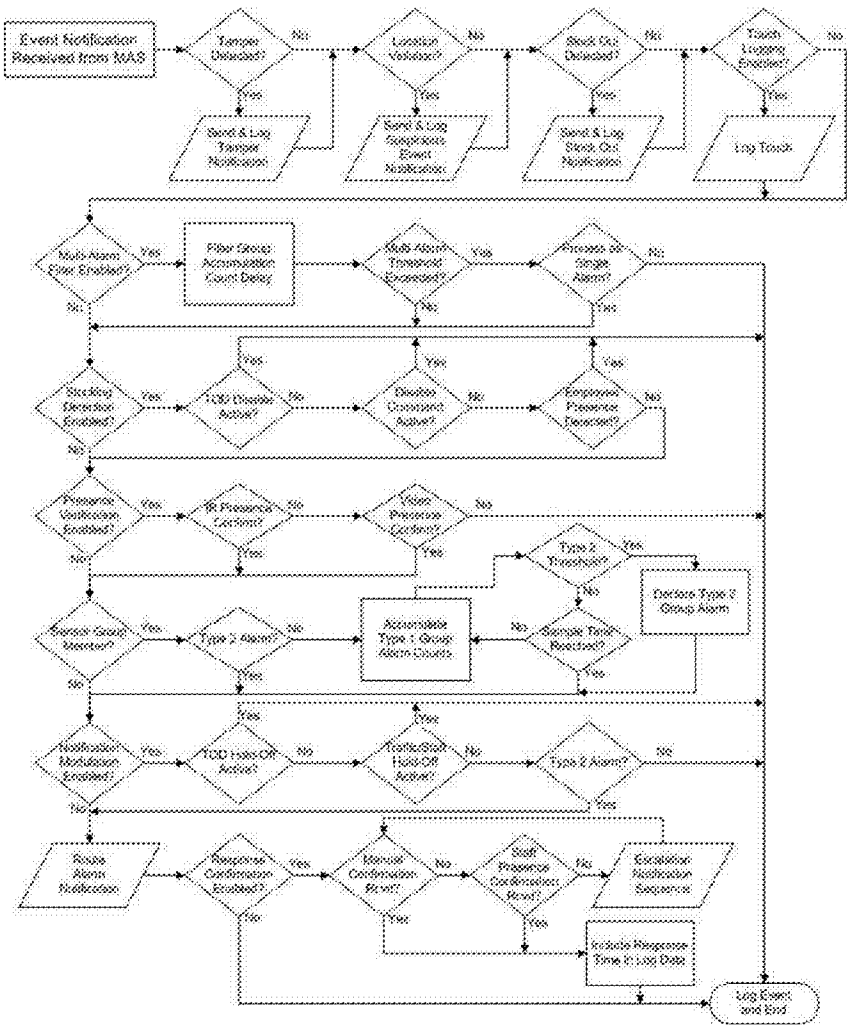
Figure 4: MAS System Level Alarm Processing

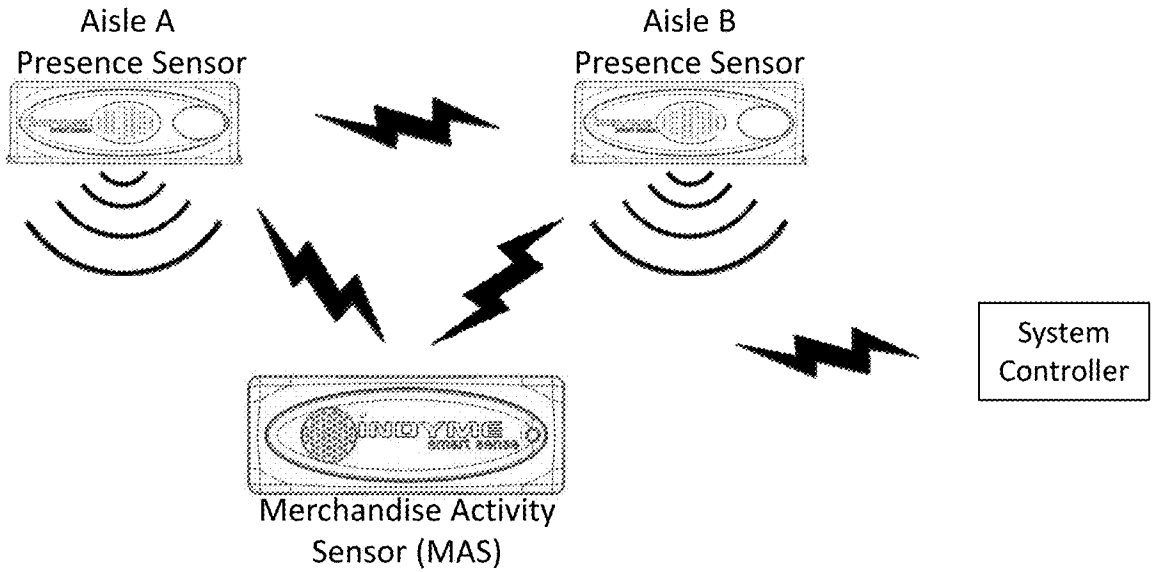
Figure 5A – Using People Presence Sensors to Filter MAS Activity Location

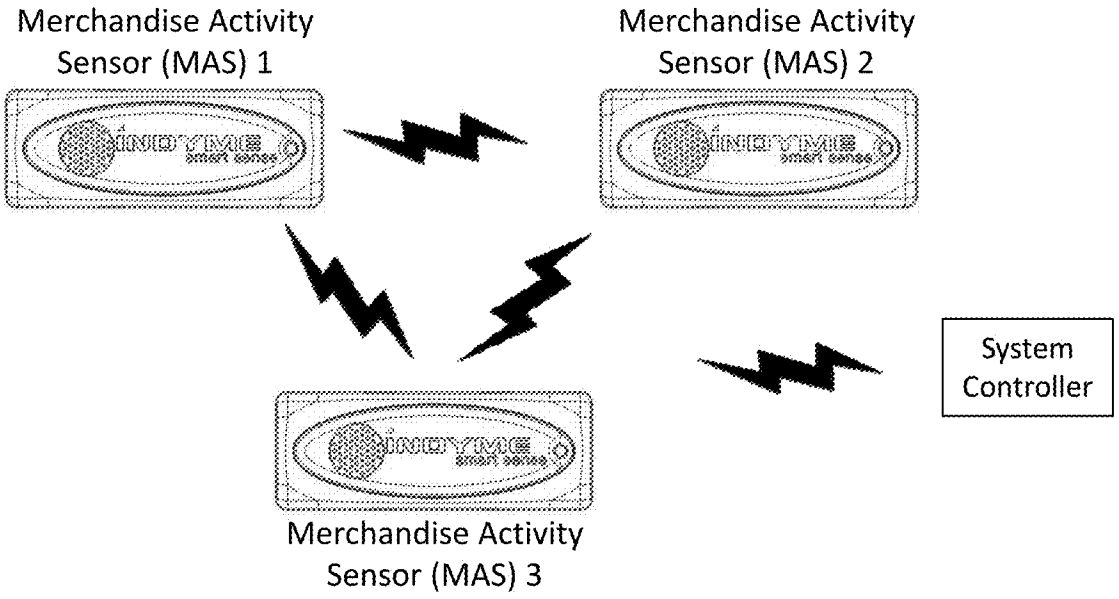
Figure 5B – Filtering and Alarm Summing by Multiple MAS

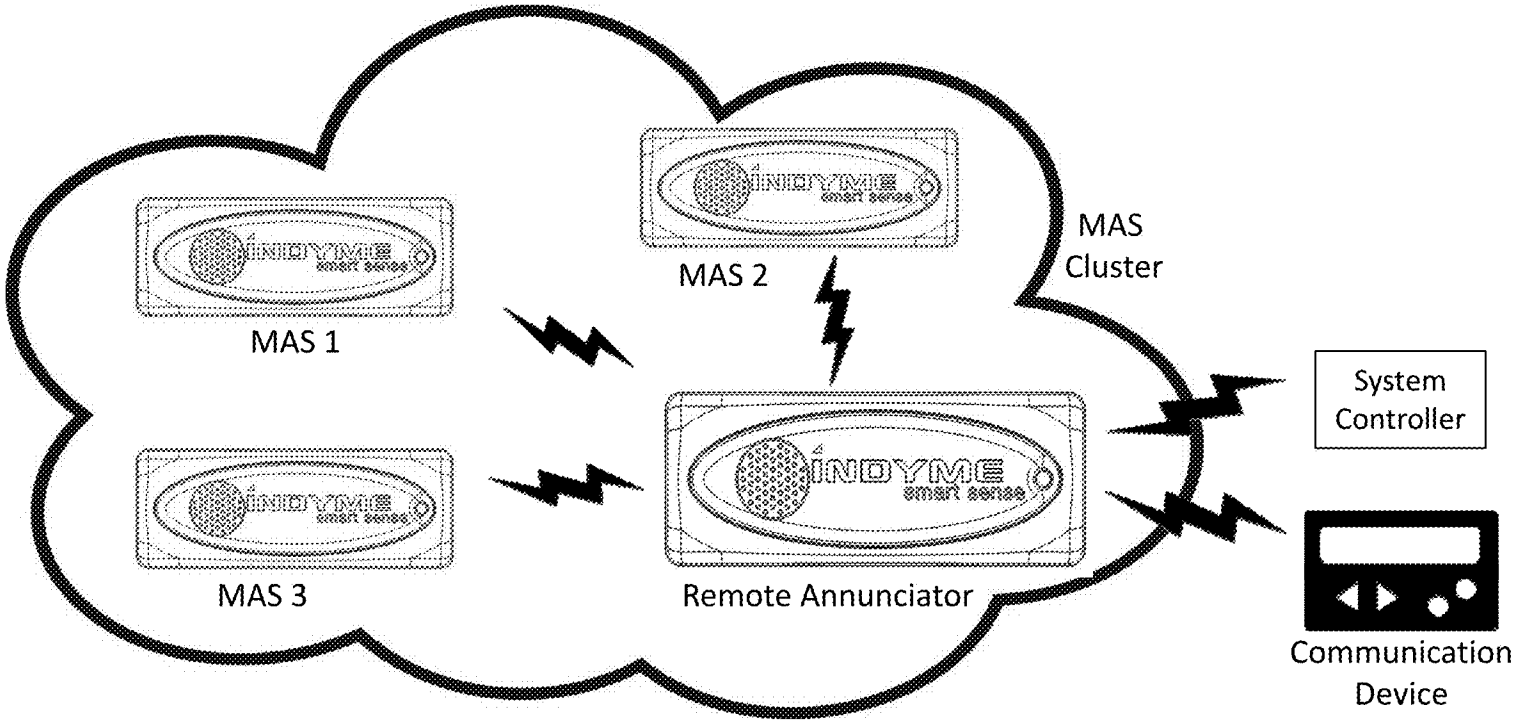
Figure 5C – MAS Cluster Processing via Remote Annunciator

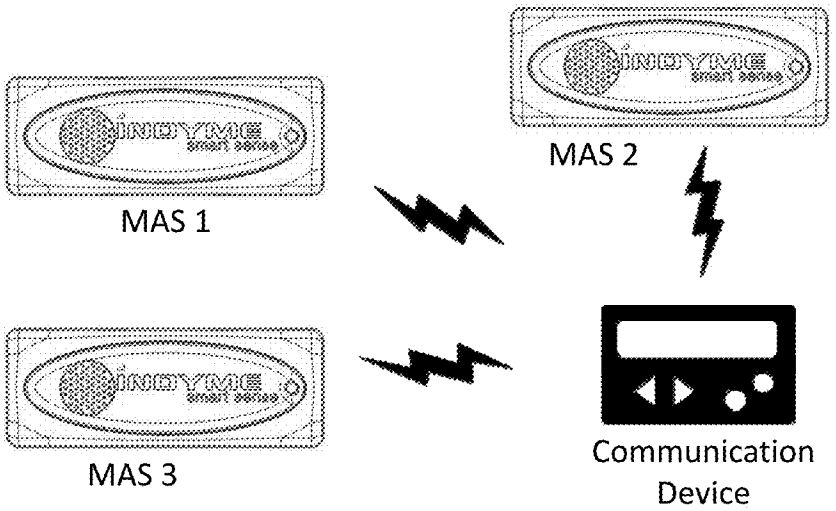
Figure 5D – MAS Notifications via Peer Communication Device

MERCHANDISE ACTIVITY SENSOR SYSTEM AND METHODS OF USING SAME

RELATED APPLICATIONS

This application claims the benefit of priority of U.S. Provisional Patent Application No. 62/052,026 filed on Sep. 18, 2014, the disclosure of which is hereby incorporated by reference in its entirety.

FIELD OF THE INVENTION

The present invention pertains generally to merchandise activity sensors. More particularly, the present invention pertains to sensors and systems using same for increasing the awareness of interactivity with merchandise on retail store displays (shelves, peg hooks, merchandise pushers, and other Point of Purchase displays) in order to facilitate more effective customer service, reduce theft and to provide additional analysis data related to merchandise/shopper interaction.

BACKGROUND OF THE INVENTION

Retailers suffer enormous losses due to theft of merchandise from the sales floor—recent studies peg this loss at $15.7 billion in 2013-2014 in the United States alone (www.GlobalRetailTheftBarometer.com). While some of this is due to individual shoplifters, an increasing proportion of the loss is through Organized Retail Crime (hereinafter "ORC") shoplifiting rings that typically use "booster teams" to sweep large quantities of select merchandise from store shelves. Shoplifters and boosters alike try very hard to escape the notice of store teams by distracting the store team or otherwise lifting merchandise in store areas not likely to be immediately noticed. Simply knowing that merchandise movement is occurring in areas susceptible to theft activity can provide the store team with increased awareness so actions can be taken to reduce these sources of shrink. Detection and prompt notification of activity typical of a sweep (rapid removal of multiple items) heightens urgency and enables store team members to take actions that can safely circumvent costly in-process sweeps.

In order to reduce and even prevent ORC, retailers employ various strategies to monitor merchandise shopper interactions. The following examples represent some of the known strategies and why there remains a need for improved merchandise activity sensing.

RFID Item-Level Tags: Placing an RFID tag on every item of interest in a store and placing an RFID reader within range of all merchandise displays can provide an excellent and superior method of detecting suspicious events (e.g., theft), stock positon, and other valuable information. However, this is prohibitively expensive—while item level tags might be justifiable on higher cost items likely to be stolen, it remains prohibitively costly to pa chase and install RFID readers capable of covering an entire store. The present invention, while providing a less elegant approach, is far less costly and still provides an awareness that helps store staff.

"NeWave Smart Shelf" by NeWave Sensor Solutions uses RFID technology but instead of placing the RFID tags on the products, the tags are mounted on the shelves such that the placement of merchandise on the tag blocks the reading of that tag. As product is removed, the tag is sensed. These are sometimes used with product pushers or other merchandising systems. Though this approach can be much more accurate in detecting an actual removal/replacement of product than the invention and can also detect shelf-stock-outs, the cost to cover a shelf is enormous in terms of the equipment required, installation of tags and readers (AC power is required), and the very significant cost of ongoing reconfiguration as merchandise planograms change.

Shopperception uses a 3D detection device mounted above a merchandise interaction fixture to detect reaches into the fixture and removal/replacement of merchandise located at specific vertical plane X/Y coordinates. This is an excellent method for detecting these interactions and is much more accurate than the invention, however, it also involves very expensive equipment that is costly to install and not practical for use at a significant number of merchandise fixtures throughout all stores in a chain. For those applications requiring less precision, the invention is economically a preferred approach.

Adhesive Tethers are typically used with expensive display merchandise (such as cameras and cell phones) to permit shoppers to hold the item within the range of a retractable tether. Removing the tether triggers an alarm. This approach will detect actual removal more accurately than the invention but is not practical for use when the actual item will be purchased by the shopper.

Patent Application WO 2014047272 (Invue Security Products) and WO 2014031651 (Southern Imperial) each disclose a device which detects motion of the product to which it is attached. Typically, this is in a "spider wrap" form factor in which a housing containing the sensor is firmly attached to relatively large high-cost merchandise; when moved from a shelf, the device can emit audio. The device also includes a light sensor such that when motion is detected and no light is sensed, it is assumed the merchandise is in a bag or otherwise obscured and possibly in the possession of a thief, which may then result in triggering an integral audio alarm. Unlike the present invention, this device must be affixed to individual merchandise items and is not suitable for smaller items.

Smart Pushers use a variety of methods to detect removal of merchandise from a pusher merchandising system; many of these also sense the amount of merchandise remaining in the pusher (including detection of stock-out conditions). While all of these will more reliably sense actual product removal than the invention, they require the considerable cost of instrumenting each pusher with sensing devices supported by electronics. By comparison, the invention can detect each merchandise dispense from any and all pushers on an entire shelving unit (i.e., multiple shelves on a rack) with a single wireless device, providing a much lower cost path to much of these benefits.

"Shelf Sensing Film" by Djb Group LLC (U.S. Pat. No. 8,695,878) is a sensing film placed on the shelf which detects the presence of merchandise placed upon the film. This can very accurately detect merchandise removal and replacement and even stock status, however, it is very expensive to install and requires considerable ongoing administration as planograms change. For purposes of basic activity detection, the invention provides a far lower cost approach and requires no special consideration in the planogram process.

In some cases, video systems with real-time analytics can detect suspicious merchandise interactions. However, reasonably thorough coverage requires a large number of cameras installed at very high expense—even then, it would be difficult for cameras to independently detect many suspicious events. As will be discussed, integration of the present invention with cameras can greatly increase the effectiveness of either solution independently.

Electronic Article Surveillance (EAS) systems trigger a local alarm at the exit door of a store when an EAS tag that has not been disarmed by a cashier prior to passing through the door. Though ubiquitous, these systems have little effect in deterring boosters (or even seasoned shoplifters) as the EAS alarm simply indicates that merchandise has just left the store and most retailers do not pursue suspects outside of the store. By comparison, a primary use of the present invention raises staff awareness at the location in the store where the merchandise is displayed, which can provide store staff with the opportunity to actually deter the theft or provide needed customer assistance. Likewise, a second use of the invention (in which a location sensing method is incorporated and the device is attached directly to high-value merchandise) provides a means of notification when an item is approaching the exit area but is still well away from the exit itself, which permits raising awareness, triggering of video capture, and other actions prior to exit.

Merchandise Dispensing Devices are typically anti-sweep mechanisms for razor blades, baby formula, and certain other high cost items that help avoid sweeps by only permitting one item to be taken at a time. These dispensing units can be quite costly and multiple items can still be removed from most of these dispensers, if only one at a time. This provides yet another application for the present invention, which can detect the unique vibration signature created with each dispense by most of these devices (as well as detect malicious efforts to gain entry into them) and drive awareness to the store team of these events.

Keeper Boxes are rugged locked plastic boxes (with integral EAS tags) which deter theft by increasing the sheer size of small valuable items, making them harder to conceal and more difficult to remove the EAS tag. However, these units take up much more shelf space, reducing the number of facings and depth of stock available for sale on the floor. Even when Keeper Boxes are used, the invention helps increase staff awareness of merchandise interactivity by detecting the removal/replacement of these boxes on store displays.

Japanese patent application 1998-140263 submitted by Tsutomu Tachibana describes triggering a musical sound on a nearby speaker (triggered by a radio transmission) when vibration on a merchandise display occurs. This would increase awareness of potential theft activity but the lack of intelligent event filtering would result in numerous notifications without regard for the likely urgency of the event or the ability of the store staff to respond, eventually reducing these notifications to background "white noise" that is increasingly ignored by store staff, negating the entire value of the device. The inability of the device to route specific location messages to various wireless communication devices typically used by store staff also seriously limits broad implementation of such a solution set. While the Tachibana approach and the present invention both use an accelerometer for sensing, the processing of that activity resulting in appropriate categorized alarm levels being delivered to appropriate store staff members provides improvements supporting ongoing effectiveness.

An additional problem area for retailers that the invention addresses is providing timely assistance to shoppers on the sales floor. Currently, it is often a somewhat random process for sales clerks to intersect with shoppers desiring assistance when and where needed. Shopper help buttons, as described in the Deal Clerk Paging System U.S. Pat. No. 4,741,020, and similar devices are used in some stores to enable shoppers to summon assistance. However, many stores find sales conversions and total sales tickets frequently increase if sales clerks approach shoppers when they are interacting with certain categories of merchandise—even when the shopper has not determined or indicated that assistance is desired. The invention provides a mechanism to empower sales teams to efficiently and proactively assist these shoppers through increased awareness of in-store activity.

In light of the above, it is an object of the present invention to provide the desired features described herein as well as additional advantages.

SUMMARY OF THE INVENTION

The present invention is a device for detecting the removal of merchandise from retail merchandise fixtures by sensing vibration patterns induced through the merchandising fixture structure. The act of removing merchandise from a display fixture induces vibration into the fixture. The Merchandise Activity Sensor (MAS), which is a battery powered wireless device, mounts to the store fixture and uses an integral single or multi-axis accelerometer to detect these vibrations. Various algorithms comprising combinations of vibration level, discernible vibration events, timing of events, quantity of events, and (in some cases) frequency content of the vibration signal are used to determine when the vibration pattern is an event of modest interest (such as typical shopping or possible shoplifting—a "Type 1 Alarm") or of high interest (such as a possible sweep incident—a "Type 2 Alarm"). Variables within these algorithms are adjusted for optimum results based on characteristics of the monitored merchandise and of the merchandise fixture type (e.g., gondola shelf, gondola pegboard hook, pusher, pallet racking, etc.).

In most cases, a Type 1 Alarm causes the device to output a local audio sound and/or to flash an integral light—these actions raise the awareness of any nearby person(s) and are known to deter theft activity. However, the service strategy of some stores is such that one or more members of the store team are notified via communication devices of most or all Type 1 events to enable them to efficiently provide a proactive service presence, which is known to increase sales. A Type 2 Alarm typically additionally results in a notification to one or more members of a store team and/or may cause a video system to automatically zero in on the area of interest for manual or automatic analysis of the event.

While this patent includes functionality on the MAS (that is, the sensor device), it must be remembered that many important functions—several of which drive certain claim—are based on system level functions including time of day and interaction with other store systems. An example already mentioned is the integration with a video system and possible collaboration to validate an alarm situation. Another example includes evaluation and intelligent alarm declarations when activity is detected by more than one MAS in the same area; yet another is when different MAS devices separately detect related events; and yet another is the modulation of alarm thresholds based on the level of traffic and/or staffing in the store.

In addition, the MAS can also be attached to actual merchandise (typically high value items), the movement of which can trigger Type 1 awareness notifications. By incorporating location awareness sensing within the MAS, awareness notifications can also include location information. For example, a MAS in range of location beacons placed at areas one would travel to exit the store could cause the MAS to trigger a Type 2 alarm that results in notifications to store personnel and video systems that include the current location of the merchandise.

MAS provides detection of merchandise interaction activity to alert store employees of possible shopper engagement opportunities that could result in building sales through up-sell/cross-sell efforts.

MAS also provides detection of suspicious merchandise interaction activity to increase store staff awareness that can help reduce actual theft from the store (shrink).

MAS further provides collection of merchandise interaction activity data for use in merchandising study analytics used typically for evaluating effectiveness of new displays, positioning, packaging, merchandise selections, and other purposes.

It is an object of the present invention to increase awareness of the location of shoppers that may desire assistance, which promotes efficient shopper engagement by store employees, often leading to increased sales.

It is another object of the present invention to increase awareness of potential theft activity at the point of theft, a location typically well inside the store, which enables staff to respond and, by mere presence, deter theft activity.

It is yet another object of the present invention to provide real time awareness of an actual theft in progress that can enable loss prevention professionals to apprehend a suspect and/or to increase the probability of conviction through the use of video push (to mobile devices and monitoring stations) and video capture triggered by MAS detected merchandise activity.

It is still another object of the present invention to provide a unique sensing method through the use of an accelerometer to detect vibrations induced into a retail store display fixture due to merchandise movement/removal/replacement. Additionally, when attached directly to a high value merchandise item, the MAS detects when the item is in motion and uses location sensing to determine if the item is entering an area in which alarm notifications should be sent, i.e., approaching a store exit.

It is another object of the present invention to be adaptable and wireless. Algorithms enable MAS to detect activity on various types of merchandising fixtures, rather than being dedicated to a single specific type. For example, merchandising pushers exhibit a very distinctive vibration signature when an item is removed from any pusher on any shelf of a store fixture (gondola). Being wireless simplifies installation since MAS can be readily installed without the need for signal or power wires. This also enables the sensor to easily adapt to new store layouts during remodels and periodic fixture or merchandise resets.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 1 illustrates a basic functional overview of the MAS.

FIG. 2 illustrates a block diagram of MAS device functional components.

FIG. 3 illustrates system level integrations used to process MAS alarms.

FIG. 4 provides a flow chart of MAS system level alarm processing.

FIG. 5A provides a first topology embodiment of MAS: People presence sensors to filter MAS activity notifications; FIG. 5B provides a second topology embodiment of MAS: Filtering and Alarm Slimming by multiple MAS; FIG. 5C provides a third topology embodiment of MAS: MAS cluster processing via remote annunciator; and FIG. 5D provides a fourth topology embodiment of MAS: MAS notifications via peer communication device.

DETAILED DESCRIPTION OF THE INVENTION

Definitions:

"Merchandise Activity Sensor (MAS)" as used in the present invention is a hardware module containing a single or multi-axis accelerometer, micro-controller, radio transceiver and/or an audio annunciator and LED, and firmware enabling it to perform the function described. "Touch" as used in the present invention is the detection of merchandise being removed or placed; MAS typically does not alarm in response to individual touches but retains activity data for reporting purposes.

"Type 1 Alarm" as used in the present invention is an alarm triggered due to detection of vibration consistent with multiple touches typical of shopping or shoplifting.

"Type 2 Alarm" as used in the present invention is an alarm triggered due to detection of rapid removal of multiple merchandise items, which may indicate a sweep in prowess.

"Notification" as used in the present invention is a message to staff via any communication device or channel including but not limited to overhead PA speakers, 2-way radio, wired or wireless telephone, smart wireless device, or pager. Notification can also include display of status on a touchscreen, computer screen, or mobility device. It can also mean sending information to another store system, such as a video management system.

"Confirmation action" as used in the present invention is an act of a staff member interacting with the system in response to a notification which results in a closed loop confirmation.

"Boosters" as used in the present invention are theft teams (most commonly working on behalf of an Organized Retail Crime ring) that typically steal large quantities of targeted merchandise from store shelves.

"Sweep" as used in the present invention is the act of removing a large quantity of the same merchandise item with the intent of theft. Sweeping is routinely practiced by Boosters.

"Gondola" as used in the present invention is the metal modular shelving units typical of supermarket aisles and may other types of stores.

"Merchandise pushers" as used in the present invention are commonly used on gondola shelves and in some types of secure merchandise dispensers for holding a row ("facing") of merchandise between two rails and using a spring-loaded pushing device to keep the merchandise firmly against a stop on the front of the shelf. When a merchandise item is removed, the pusher "pops" the row of merchandise forward to fill the empty space.

A functional overview of the MAS is provided in FIG. 1. When a single package is removed from a retail merchandise fixture, the MAS registers this as a touch. If one or more touches are detected meeting definable criteria, the LED flashes once and the annunciator beeps indicating a typical shopping event occurred. In the alternative, when multiple packages are removed from a retail merchandise fixture within a short period of time meeting definable criteria, the MAS LED alarm flashes, the annunciator alarm sounds, and a remote notification occurs indicating a potential sweep or at least multiple item movement requiring investigation. A radio transceiver sends the alarm to the system controller which in turn sends a notification alarm to a communication device (such as 2-way radios, pagers, wireless phones, smart mobile devices, PA loudspeakers, etc.).

Operating Sequence:

The following description is a typical operating sequence of MAS provided as an example of the functionality of the invention and is in no way meant to limit the scope of the invention and/or its capabilities. The operating variables permit the elimination and modification of operating steps based on user preference and potential situations.

In the static state, the microprocessor unit is in a low power sleep mode. The detection of vibrations by the integral accelerometer that exceed a set variable threshold "wakes up" the microprocessor unit.

The microprocessor uses assigned, pre-programed (or learned) algorithms to evaluate vibration amplitude levels across time to determine if merchandise movement meeting criteria for declaring a Type 1 alarm have occurred. If yes (conditions meet the criteria for a Type 1 alarm), the local audio annunciator and/or visual indicator (typically a LED) are momentarily activated to alert the shopper/thief that activity has been detected. The annunciator and indicator are typically integral to the MAS device. However, since MAS must be mounted for optimum vibration sensing, a separate nearby module (the "Remote Annunciator") positioned for optimum visibility and controlled by MAS via wire or wireless signal may provide auxiliary annunciation/indication. If conditions do not meet the criteria for a Type 1 alarm or if no further vibration is detected after a Type 1 alarm, the microprocessor recalibrates for the next event and returns to the low power sleep mode. Optionally, MAS can be configured to transmit a Type 1 alarm to the system controller, such as may be desired for high service touch environments or to gather data related to routine shopping activity. As a further option, data can also be retained at the device level and accumulated for periodic transmission to the infrastructure level as a means for reducing the quantity of transmissions and extending battery life.

After an alarm event and/or periodically, the MAS internally recalibrates the accelerometer, for example, a precisely mounted 3-axis accelerometer typically senses 0 g's in two axis and 1 g in the vertical axis but off-axis installation are compensated through the calibration process. The recalibration also resets the threshold to normalize out any ambient vibration not considered by the algorithms for alarm determination.

The microprocessor continues to evaluate the vibration to determine if based on the assigned algorithm, conditions meeting criteria for declaring a Type 2 alarm occur. If yes, the conditions meet the criteria for a Type 2 alarm, the radio transmits this event trigger to the System Controller, which follows business rules that typically result in one or more notifications to employees or other systems. Optionally, the annunciator and/or LED on the MAS device or the Remote Annunciator may activate for a lengthier period of time or with escalated volume and content (such as a voice message) relative to a Type 1 event. Though this example illustrates a Type 1 followed by Type 2 alarm, it is not necessary to transition through a Type 1 prior to declaring a Type 2 alarm. For example, vibration activity of a rapid repeated or extended nature exceeding defined time duration and/or amplitude thresholds may constitute an immediate Type 2 alarm.

Alarm Algorithms:

Various algorithms determine alarm conditions. Vibration amplitude, duration of vibration, and repeated incidents of vibration activities are most commonly evaluated for alarm determination. However, frequency domain information using Fast Fourier Transform (FFT) or other analysis may also he used to identify specific vibration signatures relevant to certain types of events. The following provide high level descriptions for anticipated algorithms and outcomes applicable to MAS:

Gondola Shelving: Tests confirm that all shelving on a gondola unit can be monitored by a single MAS. Vibration induced into the shelving transmits through the uprights and into the backboard, where the MAS typically mounts. The algorithm sensitivity level is dependent upon the type of merchandise on the shelves (e.g., heavy or light).

Pallet Rack Shelving: Palled rack shelving is typical of large DIY warehouse stores. Like gondolas, a MAS can typically detect merchandise movement on multiple shelves of pallet rack shelving. However, due to the heavy construction of these fixtures, for best detection on some types of merchandise, the MAS would mount directly to the bottom of a shelf. Also like gondolas, algorithm sensitivity is dependent on merchandise type.

Peg Hooks: Tests have shown excellent detection of merchandise removal from gondola peg hooks mounted anywhere on a monitored pegboard. This removal generates a very characteristic vibration signature that is readily detected. Multiple incidences of this signature across a limited time frame is used to distinguish between typical shopping behavior (Type 1 Alarms) and possible sweep activity (Type 2 alarms). Monitoring can also be effective on peg hooks and hangars mounted to slat panels, wire racks, and other fixtures that support hanging merchandise.

Locked Peg Hooks: Peg hooks with integral locking mechanisms, which require assistance from sales staff to access the desired merchandise, are commonly used to reduce theft of high-value items. Thieves sometimes circumvent this by cutting the merchandise packaging to remove the item. MAS can detect this cutting activity due to the vibration induced into the fixture.

Cardboard Fixtures: Many stores use temporary fixtures constructed of cardboard or corrugated plastic. Testing confirms that algorithms similar to those effective on gondola shelving will also perform well on these temporary fixtures.

Clothing Hangers: Testing has not been performed to characterize clothes hanger fixtures typical of apparel stores. However, it is predicted that the movement of a hangar will create a readily identifiable vibration signature.

Merchandise Pushers: When an item is removed from a pusher and the remaining merchandise snaps forward, a very characteristic vibration signature is generated—this is readily detected by MAS from any pusher on an entire gondola unit. This means MAS can readily determine a fairly accurate count of dispenses, which is then used to define Type 1 and 2 alarms. Also, a large vibration amplitude typically indicates removal of multiple items from a single facing, which can also be used to declare a Type 2 alarm. There are two unique advantages when using MAS with pushers versus most other merchandising systems: Dispenses can be distinguished from placing the merchandise back into the pusher, making the dispense detection alarms much more definitive; and dispenses of the last item in a pusher facing (constituting stock-out of that facing) creates a vibration signature uniquely identifiable relative to other dispenses. This enables MAS to detect this stock-out and send a unique alarm message to that effect. In some cases, metal "taps" or other devices may be attached to the pusher to make this stock-out dispense even more identifiable due to high vibration amplitude, distinctive duration and/or frequency, or multiple sharp vibration spikes ("ringing").

Merchandise Dispensers (with clickers): A number of anti-sweep merchandise dispensers require shoppers to turn a knob or take a similar action to dispense each product item. These knobs often incorporate a "clicker" that creates a clicking sound intended to raise store employee awareness of the event (i.e., an extended clicking session might indicate a sweep in progress). The MAS can detect these clicks when the dispensers and MAS are mounted on the same gondola assembly. Each click emits a readily identifiable vibration signature and the MAS can be calibrated with the quantity of clicks equating to a single dispense. From this, Type 1 and 2 Alarm events can be declared. In some types of dispensers a facing stock-out event can be detected using methods similar to merchandise pushers (a form of which are often incorporated in these dispensers).

Ambient Vibration Auto-Adjust: Some store environments, such as sales floors in multiple-story buildings, may have ambient vibration levels induced into the fixtures due to HVAC equipment or other sources. The MAS can be configured to automatically adjust its base detection threshold to normalize out this ambient vibration while still enabling the unit to detect events of interest.

Alarm Learn Mode: While algorithms are typically defined based on the factors previously outlined, an alternative method is to place the MAS into "Learn Mode" then perform events that minimally define a Level 1 and a Level 2 Alarm. MAS will then auto-set these variables (such as sensitivity threshold and quantity of events within an elapsed time period) to detect similar events in the future. The preferred method of invoking learn mode and entering relevant information can be performed using a smart mobile device (linked to the system Controller or directly to the MAS using various wireless technologies), a computer linked to the System controller locally or remotely, an infrared controller (similar to a television remote control) communicating directly to the MAS device through an infrared portal, or even using switches integral to the MAS device.

Tamper Alarm: Once the MAS is mounted and calibrated, its multi-axis accelerometer senses orientation (i.e., which way is down). An unexpected dismounting of the device can be quickly detected by the device and designated a Tamper Event, which would typically create a very aggressive local annunciation and the transmission of a Tamper Alarm to the System controller, which can then output the appropriate notifications.

Optional Functionality:

The following related fractions are typically implemented at the system and ecosystem levels (rather at the MAS end device level., though some of these can be implemented through MAS-level peer interactivity) and may be offered on an optional basis:

Traffic Alarm Modulation: Integration of the System Controller with the store's traffic counting system (which counts people going in and out of the store and often calculating how many are in the store at any given time) enables the System Controller to make intelligent decisions regarding sending Notifications relative to merchandise activity alarms. For example, during a peak shopping time when many shoppers are in the store, much more merchandise activity is to be expected and, most likely, the store is staffed more heavily than usual. In this situation, merchandise activity resulting in a Type 2 Alarm in some areas of the store (such as merchandise least likely to benefit from personal assistance and/or be victimized by a sweep) may not result in Notifications to store personnel. At the other extreme, during very light traffic periods when store staffing may be lean, it may even be desirable to provide Type 1 Alarm notifications in select high margin/high service merchandise areas to promote shopper engagement by store staff.

Time Clock Alarm Modulation: Integration with the store's time clock system enables the System Controller to monitor the number of staff clocked in as "on duty" and can be used to intelligently filter the Type 1 and Type 2 alarms that actually result in notification to store personnel. Combining Time Clock and Traffic Data provides a further level of alarm modulation by considering both conditions prior to issuing alarm notifications.

Proximity Multi-Alarm Consolidation Filtering: Some vibration incidents may be detected by more than one MAS. For example, a long multi-section gondola shelf may be outfitted with several MAS—perhaps one for each gondola segment. Movement of heavy merchandise could trigger simultaneous alarms in more than one MAS. When this occurs among multiple MAS mounted on the same structure or otherwise in close proximity, the System Controller or a MAS devices peer-to-peer collaboration scheme can be configured to consolidate these alarm events into a single notification.

Alarm Summing by Multiple MAS Devices: MAS devices mounted on different store fixtures in the same vicinity each detecting touches at or below Type 1 alarm levels might collectively be identified as constituting a Type 2 alarm since this activity may indicate a sly sweeper removing merchandise from different fixtures to avoid detection.

Broad Multi-Alarm Auto-Disable: Certain events, such as an earthquake, a subway passing nearby, or a heavy forklift on a flexible floor, can trigger alarms on many or even all MAS in a store. The System Controller or a MAS devices peer-to-peer collaboration scheme can be configured to identify this as a special event that results in a special consolidated notification or no notifications.

Video System Integration Functions: Integrating with a store Video Management System (VMS) enables the MAS System Controller to notify the VMS of alarm incidences. This can result in the following response behaviors: A camera can automatically direct its focus to the location at which the alarm is occurring, permitting fewer cameras in the store to more efficiently monitor events of interest; The video related to the event can be viewed in real time by a remote person or pushed directly to a mobile device carried by personnel in the store, who cart then assess the situation and determine what actions, if any, should be taken; or a smart VMS now directed by MAS to the event of interest may use analytics to detect sweep events and certain other events of interest, which can then result in an escalated notification or other actions.

Stocking Disable: A potential disadvantage of the MAS method of sensing merchandise movement is the difficulty of differentiating legitimate stocking activity from sweep activity (though this is less of a challenge with merchandise pushers, as noted previously). Methods to address this issue include:

Store Hours Alarm Filter: During closed hours when a great deal of stocking occurs, the MAS devices and/or the System Controller notifications are automatically disabled;

Manual Disable Command: Using a mobile communication device, a computer, or other device communicating with the system Controller and/or a MAS device, an authorized store team member can temporarily disable alarm Notifications originating from one or more MAS devices or the entire system. This can involve manual entry of information or using the mobile communication device to capture information from a bar code, QR code, NFC tag, or beacon; and Auto-Recognition of Employees: The presence of one or more store employees in the immediate vicinity of an alarming MAS can automatically disable notifications. Auto-recognition methods include: VMS recognition of the vest or hat color/pattern of team member uniforms; and Beacon or other micro-location methods detecting a device carried (e.g., smart mobility device) or worn (e.g., RFID or beacon/WiFi tag) by employees.

Location Awareness: Optional location sensing (such as beacons or "WiFi Tag" methods) enables the MAS to be aware of its location. This information can be used for determining the location of the MAS during initial set up, subsequent re-location, and alarms when in motion (i.e., when affixed to a merchandise item).

Merchandise Interaction Detection: MAS activity data can also populate a database used to analyze shopper merchandise interactions. Depending on the intended use of the data, the detection algorithm may be adjusted to be more or less sensitive for defining an event of interest. For example, every merchandise touch interaction may be reported and, when correlated with Point of Sale (POS) data, can provide a view of sale conversion relative to merchandise interaction.

Confirmation Action: The system can provide data measuring the response effectiveness of store personnel to MAS alarm Notifications. This requires a means of determining that an employee went to the location of the alarm within a reasonable amount of time after the Notification. The method may be as simple as pressing a button integral or ancillary to the MAS module or similar implementations of previously described Manual Disable Command or Auto-Recognition of Employees.

Summon Assistance: The MAS could be attached to the inside of a door or window such that a person desiring access or assistance could knock and the MAS would trigger the system to summon someone. For example, 3 knocks on the door or window could be interpreted by the algorithm as a valid request. This application may be helpful in the following instances:

Closed Hours Associate Access: Store employees arriving for work when the store is closed often have difficulty getting the attention of someone in the store to let them in, which can be dangerous during dark winter early morning hours. Knocking on the glass triggers MAS and, if the system validates that the store is closed, the store staff is notified.

Receiving Door Access: Delivery drivers are often delayed at retail stores due to difficulty raising the attention of an employee to open the receiving door. Simply knocking on the door can trigger a notification summoning assistance from anywhere in the store.

System Level Alarm Processing:

To better understand system level operation of the invention, refer to FIG. 3 for a view of typical system level integrations and the following discussion explaining the FIG. 4 flow chart. It should be understood that the sequence of the various subroutines shown in this figure can be re-arranged as desired to optimally meet application requirements.

System level alarm processing commences with reception of an alarm (or event) notification from a MAS module. Module tamper alarms and location violations (a mobile module entering an alarm zone) immediately result in an urgent Notification. Stock out detections (such as removal of the last item on a pusher facing) trigger a Notification and are logged to a stocking tracking application for further processing. If the system is configured to track Touches, each received alarm is logged.

The "Multi-Alarm Filter" subroutine counts each simultaneous alarm occurrence from multiple MAS devices in a designated group of sensors as a single occurrence. These consolidated alarm events are then evaluated for possible Type 1 or Type 2 alarm declaration and Notification as a single event. This function filters out such as merchandise removal detected on adjacent fixtures and unusual events such as a fork lift striking a fixture outfitted with multiple sensors or even an earthquake shaking all sensors in the store.

The "Stocking Detection" subroutine disables the processing of alarms when merchandise may be stocked on monitored fixtures. Methods used to enter this mode include designated Time of Day (TOD) day parts (such as when the store is closed), a command from an authorized store employee (such as via a mobile device, network device, or designated button), or automatic detection of store employee presence by video recognition, RFID location, beacons, or similar methods.

"Presence Verification" uses one or more infrared sensors and/or real time video analytics to confirm that one or more persons are present at the alarm location. For example, a sensor may be triggered by interactions on either side (that is, either aisle) that the fixture faces. Presence verification enables the System Controller or MAS devices peer-to-peer collaboration to determine in which aisle the activity actually occurred and to issue a Notification for the appropriate aisle—or no Notification at all if the merchandise in the occupied aisle is not of monitoring interest.

"Sensor Groups" provide a means for summing activity across multiple adjacent/nearby fixtures. While the sensor at each fixture may detect a Type 1 event, collectively these individual events may be upgraded to Type 2 alarm.

"Notification Modulation" avoids the generation of excessive Notifications (especially Type 1 alarms) based on various conditions including TOD Day Part, the amount of shopper traffic in the store (typically detected by entrance/exit sensors), and the amount of store staff available (typically determined through real time clock data). These factors may regulate preclude the issuance of some Notifications and or may define the minimum time intervals during which Notifications to a given routing destination (such as to personnel serving a specific department) will be launched.

Notifications may route to store personnel via a variety of paths (e.g., overhead speakers, pagers, smart mobile devices, wireless phones, display screens, etc.) and the invention can be configured to escalate notifications if store personnel are expected to respond to these Notifications. Response is determined either by the responding person pressing a button or taking a similar action at the alarm area or can be determined by automatic detection of staff entering the area (typically using video recognition, RFID, beacons, or similar technologies).

Direct Merchandise Attachment:

The primary application of the invention involves mounting the MAS to a store fixture and detecting vibrations induced into the fixture by merchandise movement activity. Another application is to affix the MAS directly to merchandise for the purpose of detecting when that merchandise is being handled. The following are provided as examples only.

Art and Statuette Gallery: A typical commercial art/tourist gallery may have many expensive items on display. It can be difficult for the staff to closely monitor all of the items and avoid the theft of display items, especially during busy times in a sizable gallery, which may have various display rooms. By affixing the MAS to the article or as a base for the article, a wireless alarm identifying the specific item can transmit as soon as someone picks up the item, resulting in Notifications much like those described in this document. For example, the video stream from a video camera trained on that display area could immediately pop up in a back office, behind a sales counter, or to a mobile device. This will permit rapid determination of the likely intent of the person with the merchandise if rapid response to avert a theft is needed or if a more casual shopper engagement approach is desired.

If the MAS is equipped with location awareness technology, as noted previously, then the location of this merchandise as it may be carried through the store/building can also be included in the notifications to personnel, camera systems, and even mapping displays. Further, MAS can declare an alarm condition based on the merchandise entering certain locations (such as approaching an exit area).

Fitness Equipment Assistance: Should a shopper step onto a display tread mill or other fitness equipment, the resulting MAS trigger can summon sales assistance to the location, which would increase shopper engagement at the point of interest and likely increase sales.

Automobile Sales Lot Theft Deterrent: The MAS may be attached to new or used autos in a car lot to detect movement of cars, including jacking up of the car in the course of removal and possible theft of tires (not an infrequent event)—such events then trigger appropriate Notifications. A means of temporarily disabling the alarm may be provided to authorize drivers/technicians. This deterrent can also apply to boats in storage and aircraft.

Practical Examples:

Example 1 is illustrated in FIG. 5A wherein a MAS mounted on a store gondola (fixture) detects merchandise movement occurring on either side of the fixture (that is, in both store aisles the fixture faces. In this configuration, Presence Sensors detect if someone is in front of the fixture when merchandise movement is detected. If a person is in the aisle on only one side of the fixture, then the notification message to store personnel will specify only that aisle for the activity alarm location. The filtering decision can occur at the System Controller (receiving transmissions from all devices) or through peer-to-peer collaboration with only the resultant alarm going to the System Controller.

Example 2 is illustrated in FIG. 5B wherein Multiple Merchandise Activity Sensors may be mounted near each other (such as on adjacent store fixtures). This proximity may utilize one of two types of processing:

Duplicate Alarm Filtering: Detection of the same alarm event by more than one MAS is reduced to a single alarm notification.

Alarm Summing: Non-duplicate merchandise activity detected by any one MAS may not exceed the alarm threshold but combined activity by two or more nearby MAS may constitute an alarm.

In both processing types, the reduction to a single alarm event may occur by communication between the MAS devices resulting in the local filtration of the alarm prior to transmission to the System Controller. In the alternative, the reduction to a single alarm event may occur by communication of the duplicate alarms to the System Controller which thereby determines if the activity threshold is met requiring further communication of the alarm event.

Example 3 is illustrated in FIG. 5C wherein the inclusion of a remote annunciator provides three key functions for a cluster of MAS devices: 1) the annunciator can be physically located to optimally provide audio and/or visual alarm annunciation in response to alarm conditions detected by any MAS in the cluster; 2) the annunciator can perform filtering and processing of an alarm event by alarm summing or dupulicate alarm consolidation at cluster level; and 3) the annunciator communicates processed alarms to the System Controller and/or directly to a compatible Communication Device, thereby eliminating the need for a System Controller.

Example 4 is illustrated in FIG. 5D wherein a communication device accepts alarm notifications directly from MAS devices, avoiding the need for a System Controller. MAS devices can use peer-to-peer communication and processing to perform alarm filtering and alarm summing, as noted previously.

One embodiment of MAS provides detection of merchandise interaction activity to alert store employees of possible shopper engagement opportunities that could result in building sales through up-sell/cross-sell efforts. When monitoring merchandise pushers, a single MAS detects each merchandise dispense and differentiates this from a stocking event. Additionally, when the last item in a facing pusher dispenses, MAS detects this and can provide notification of the stocks out incident.

In another embodiment, MAS provides detection of suspicious merchandise interaction activity to increase store staff awareness that can help reduce actual theft from the store (shrink).

In still another embodiment, MAS further provides collection of merchandise interaction activity data for use in merchandising study analytics used typically for evaluating effectiveness of new displays, positioning, and packaging.

In yet another embodiment, MAS reduces wait time of customers and delivery persons by summoning assistance to locked doors and counter windows such that the knocking on a door or window triggers staff notifications.

In still a further embodiment, MAS provides a system capable of filtering duplicate alarm events locally at the sensor level or at the system controller level.

In another embodiment, MAS provides a system capable of summing alarm events to detect if the combination of non-duplicate alarms meet a preset threshold requiring further transmission to a communication device wherein summing may occur locally at the sensor level or at the System Controller level.

It will be appreciated that details of the foregoing embodiments, given for purposes of illustration, are not to be construed as limiting the scope of the invention. Although several embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is further defined in the converted utility application and appended claims. Further, it is recognized that many embodiments may be conceived that do not achieve all the advantages of some embodiments, particularly preferred embodiments, yet the absence of a particular advantage shall not be construed to necessarily mean that such an embodiment is outside the scope of the present invention.

We claim:

1. A system for providing real-time location based services in a retail setting, the system comprising:

a) at least one proximity detection feature for identifying a presence of a mobile device and its associated location, wherein the mobile device is meant to move freely in and out of range of the proximity detection feature;

b) at least a first sensor capable of detecting a direct or indirect force that is applied to an object which results in movement of that object from a state of equilibrium and further wherein the detection of the movement activates the at least one proximity detection feature to locate and identify the mobile device;

c) a microcontroller having a customizable application capable of processing all the data acquired by a) and b); and d) a wired or wireless means of communication capable of communicating the movement of the object detected by the first sensor to the microcontroller, wherein the at least first sensor is attached to a static fixture.

2. The system of claim 1 wherein the fixture is in contact with the object.

3. The system of claim 1 wherein a direct force is detected when the at least first sensor is associated with an object.

4. The system of claim 1 wherein the real-time location based services are configured for use in a setting wherein the detection and tracking of object movement is desired.

5. The system of claim 1 wherein the at least first sensor further comprises a single or multi-axis accelerometer.

6. The system of claim 1 wherein the means of communication is a transceiver.

7. The system of claim 1 wherein the means of communication is a transmitter.

8. The system of claim 1 wherein the microcontroller is capable of determining a precise location of a mobile device based on the acquired data.

9. The system of claim 8 wherein a closest identified mobile device to the activated sensor is recognized by the microcontroller which results in the communication of customized information to the mobile device.

10. The system of claim 1 wherein the microcontroller is capable of determining the object or a category of objects by providing a shelf planogram over the location of the at least first sensor.

11. A method of detecting potential theft related activity at a point of display in a shopper self-checkout environment using a mobile device, the system comprising:

a) providing at least one proximity detection method for identifying a presence of a mobile device and its associated location, wherein the mobile device is associated with prior purchase activity by a user;

b) providing at least a first sensor capable of detecting a direct or indirect force that is applied to an object which results in movement of that object from a state of equilibrium;

c) providing a microcontroller having a customizable application capable of processing all the data acquired by a) and b) in combination with purchase activity from the mobile device;

d) providing a wired or wireless means of communication capable of communicating the movement detected by the at least first sensor to the microcontroller of c) for processing; and e) triggering a suspicious event declaration when movement detected does not match purchase data obtained from the mobile device.

12. The method of claim 11 wherein an indirect force is detected when the at least first sensor is associated with a fixture.

13. The method of claim 11 wherein the fixture is in contact with the object.

14. The method of claim 11 wherein a direct force is detected when the at least first sensor is associated with an object.

15. The method of claim 11 wherein the real-time location based services are configured for use in a setting wherein the detection and tracking of object movement is desired.

16. The method of claim 15 wherein the setting is a retail setting.

17. The method of claim 11 wherein the at least first sensor further comprises a single or multi-axis accelerometer.

18. The method of claim 11 wherein the means of communication is a transceiver.

* * * * *